US006737617B1

(12) United States Patent
Daum et al.

(10) Patent No.: US 6,737,617 B1
(45) Date of Patent: May 18, 2004

(54) METHODS AND APPARATUS FOR A SIGNAL DISTORTION BASED DETECTION SYSTEM

(75) Inventors: Wolfgang Daum, Louisville, KY (US); Tam Nolan, Louisville, KY (US); Gregory Stuart Simms, Louisville, KY (US); Dan Lewis Ahks, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/489,898

(22) Filed: Jan. 24, 2000

(51) Int. Cl.[7] ..... H05B 6/06; H05B 6/12

(52) U.S. Cl. ..... 219/626; 219/665; 219/667; 219/627; 219/518; 324/239

(58) Field of Search ..... 219/620, 621, 219/623, 625, 626, 627, 661, 662, 663, 665, 667, 671, 518; 324/239, 243

(56) References Cited

U.S. PATENT DOCUMENTS

| | | | | |
|---|---|---|---|---|
| 3,823,297 A | | 7/1974 | Cunningham | |
| 4,016,392 A | | 4/1977 | Kobayashi et al. | |
| 4,169,222 A | * | 9/1979 | Tucker | 219/626 |
| 4,334,135 A | * | 6/1982 | Smith | 219/626 |
| 4,352,000 A | | 9/1982 | Fujishima et al. | |
| 4,447,691 A | | 5/1984 | Mizukawa et al. | |
| 4,456,807 A | * | 6/1984 | Ogino et al. | 219/626 |
| 4,868,504 A | * | 9/1989 | Johnson | 324/329 |
| 5,296,684 A | | 3/1994 | Essig et al. | |
| 5,424,512 A | | 6/1995 | Turetta et al. | |
| 5,893,996 A | | 4/1999 | Gross et al. | |

FOREIGN PATENT DOCUMENTS

| | | | | |
|---|---|---|---|---|
| JP | 62-067484 | * | 3/1987 | 324/239 |

* cited by examiner

*Primary Examiner*—Philip H. Leung
(74) *Attorney, Agent, or Firm*—H. Neil Houser, Esq.; Armstrong Teasdale LLP

(57) ABSTRACT

Methods and Apparatus for detecting the presence of a conductor near an inductive coupling loop are disclosed. The method includes supplying an excitation to the coupling loop, measuring the signal distortion induced by the excitation signal, and monitoring the distortion in the signal for a change in harmonic content.

18 Claims, 2 Drawing Sheets

METHODS AND APPARATUS FOR A SIGNAL DISTORTION BASED DETECTION SYSTEM

BACKGROUND OF THE INVENTION

This invention relates generally to the detection of conductors near inductive coupling loops, and more specifically to the detection of cookware on a cooktop or heating surface and determination of the size and/or the temperature of the cookware located thereon.

Cookware detection, size determination, and temperature determination features for induction heating cooking appliances provide added convenience to usera as well as allowing an added level of safety to be incorporated into cooking surface control schemes. For example, in some induction cooktops, power is disabled to heating elements until a presence of an item of cookware is detected on the cooktop, therfore providing automatic power control to heating elements while conserving energy and at least partially reducing a likelihood of injury from contact with unoccupied heating elements.

In at least one known pan detection system, an induction coil is used and the presence of an item of cookware on the cooking surface induces frequency changes detected in a detection circuit coupled to the controls for operating heating elements. However, electronic components used in such applications are sensitive to heat degradation because the heat generated in a cooking surface environment changes electronic components values and tolerances over time. In addition, during cooking cycles, the electronic components are exposed to fluctuating heat generated in the cooking elements so electronic component values and characteristics fluctuate during the cooking cycle. As applied to the known detection systems, the heat fluctuation in the cooking environment, and thus the fluctuations in component value, induces fluctuations in a detected frequency in the detection circuit. These fluctuations in frequency require a sophisticated control circuit with a particular bandwidth to accurately detect presence of cookware and to control heating elements accordingly.

Accordingly, it would therefore be desirable to provide a circuit for accurately detecting cookware presence and size for an induction based cooking system that is not based upon frequency change as the detection mechanism, thereby eliminating the problems associated with fluctuating component values induced by exposure to heat in the cooking environment.

BRIEF SUMMARY OF THE INVENTION

In an exemplary embodiment of the invention, a method of detecting the presence of a conductor, for example a piece of cookware, near an inductive coupling loop includes the steps of introducing an excitation signal to a coupling loop, measuring the amount of signal distortion induced in the coupling loop by the excitation signal, and monitoring the harmonic content of the distorted signal.

The inductive coupling loop is located within a cooking surface or cooktop, near a heating element. A signal generating circuit is used to generate an excitation signal that is applied to the coupling loop. The effect of a conductor, such as a piece of cookware, is to distort the excitation signal as the cookware is positioned over the coupling loop. The distortion is in the form of harmonics of the excitation signal, and the harmonics are detected with a detection circuit. Therefore by detecting signal distortion harmonics rather than frequency changes, a cookware detection system is provided that is not as susceptible to heat effects of the cooktop in comparison to known detection systems.

DETAILED DESCRIPTION OF THE INVENTION

Figure 1:
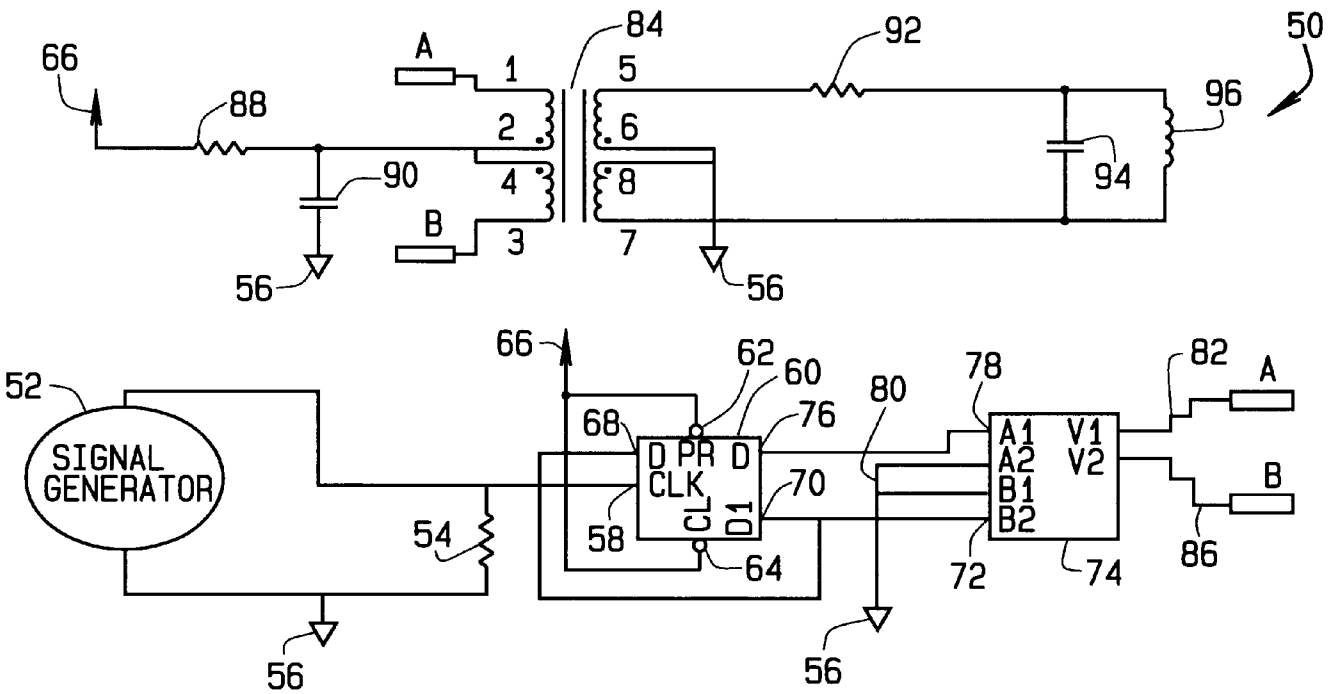
FIG. 1 is a schematic diagram of a signal distortion based detection system.

FIG. 1 is a circuit schematic diagram of an exemplary detection circuit, or unit, 50 that may be used, for example, to detect cookware on an induction cooking surface or cooktop. Generally, unit 50 induces a signal into an inductive loop which is embedded within a cooktop (not shown in FIG. 1), as described below in more detail. The induced signal, along with the presence of a conductor, such as a piece of cookware placed near the inductive loop, distorts the signal in the inductive loop and causes changes in the harmonics of the induced signal that may be seen at the inductive loop and detected, as further described below, to control cooktop heating elements accordingly.

Unit 50 includes a known signal generating source 52, for example, an oscillator circuit, that is connected in parallel with a load resistor 54. A first terminal of load resistor 54 and signal generating source 52 is connected to circuit ground 56. A second terminal of load resistor 54 and signal generating source 52 are connected to a clock input 58 of a D-type flip-flop 60. Preset 62 and clear 64 inputs to the D-type flip-flop 60 are connected to a voltage source 66. The D input 68 to the D-type flip-flop 60 is connected to the $Q_{not}$ output 70 of the D-type flip-flop 60. The $Q_{not}$ output 70 of the D-type flip-flop 60 is connected to the B2 input 72 of an open collector driver 74. The Q output 76 of the D-type flip-flop 60 is connected to the A1 input 78 of open collector driver 74. The A2 and B1 inputs 80 of open collector driver 74 are connected to circuit ground 56. Although unit 50 as described and illustrated in terms of clocking a signal through a flip-flop, it is understood that other combinatorial logic circuits could be used in the circuit within the scope of the present invention. Therefore, the invention is not limited to the specific embodiment of exemplary unit 50.

Output Y1 82 of open collector driver 74 is connected to lead one of transformer 84. Transformer 84 has a balanced internal capacitance and a high tolerance for mismatched loads. Output Y2 86 of open collector driver 74 is connected to lead three of transformer 84. Leads two and four of transformer 84 are electrically connected to one another and to a first terminal of resistor 88 and a first terminal of capacitor 90. A second terminal of resistor 88 is connected to the voltage source 66. A second terminal of capacitor 90 is connected to circuit ground 56. Leads six and eight of transformer 84 are electrically connected to one another and further connected to circuit ground 56. Lead five of transformer 84 is connected to a first terminal of resistor 92. A second terminal of resistor 92 is connected to a first terminal of capacitor 94 and a first terminal of inductor 96. Lead seven of transformer 84 is connected to a second terminal of capacitor 94 and a second terminal of inductor 96. Inductor 96 serves as the sensor for the circuit and is also referred to as a coupling loop.

Figure 2:
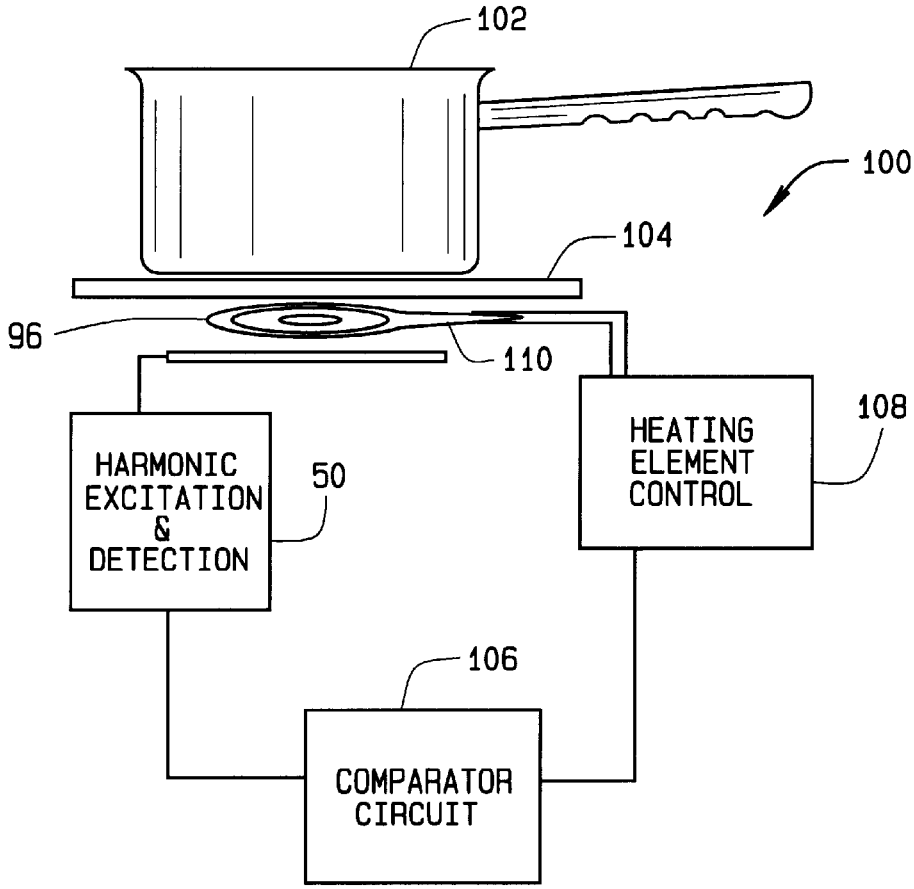
FIG. 2 is schematic view of an exemplary pan presence and pan size detection system.

FIG. 2 depicts an exemplary pan presence and pan size detection system 100 configured to measure signal distortion given a predefined non-varying excitation signal. Therefore, the losses and hence the amount of harmonic content in the excitation signal is varying given the placement of a conductive pan 102 on a heating surface 104 near the coupling loop 96. The circuit design described in relation to FIG. 1 uses push/pull circuitry and a balanced load in order to cancel the even harmonics of the excitation signal, and the presence of a conductive pan 102 introduces detectable changes in the odd harmonics of the excitation signal, the presence of which are verified using a gated comparator circuit 106. In one exemplary embodiment, a third harmonic of the excitation signal is detected using gated comparator circuit 106. In alternative embodiments, any odd harmonic or a sum of any number of odd harmonics can be detected. If the circuit does not have a balanced load, even harmonics of the excitation signal can be detected. In this approach, a frequency bandwidth is inconsequential since no change in frequency is required, unlike existing detection systems. In addition, a size of a cooking pan 102 is also determined by changes in harmonic content of the excitation signal because different size cookware 102 contains varying conductive material content, thereby allowing not only the presence of cookware 102 to be detected, but the relative size of cookware 102 using properly calibrated detection circuits.

Using a pan presence and pan size detection system as described above, such as exemplary system 100, cookware presence and size may be detected according to the following method. An excitation signal is introduced to the coupling loop. In the following step, an amount of signal distortion on the coupling loop is measured. The signal distortion is induced by the excitation signal and caused by the presence of a conductor, such as a piece of cookware, near the coupling loop. The signal distortion at the coupling loop is monitored for a change in harmonic content, thereby detecting the presence of such a conductor.

In another aspect of the invention, losses in harmonic level (a change in the amount of signal distortion) directly related to temperature inside the cooking pan 102 are used for detection purposes. Measuring loss in harmonic level allows boil detection and control. In a further embodiment, detector unit 50 may be coupled to audible or visual alarms to alert users of boiling conditions To detect and control boil, a circuit, such as a gated comparator circuit 106, is used to detect harmonic level change to control a heating element control circuit 108 which in turn supplies power to a heating element 110.

In a further embodiment, multiple heating elements are located in a cooking surface, such as those found in a residential or commercial cooking appliances, and each heating element is controlled and monitored using the inductive coupling loop circuit and method.

By using the inductive coupling loop and using an excitation circuit to induce harmonics to be monitored by a circuit, safe detection of cookware, or lack thereof, and the monitoring of size and temperature of the cookware is achieved. In addition, focusing on harmonic detection, as opposed to known pan detection systems and methods that monitor changes in frequency, allows for a simpler and more cost effective circuit design. Performance of the circuit is substantially unaffected by heat fluctuations generated during heating cycles. Accurate cookware detection is provided despite variations in electronic component values over time due to multiple heating and cooling cycles.

While the invention has been described in terms of various specific embodiments, those skilled in the art will recognize that the invention can be practiced with modification within the spirit and scope of the claims.

What is claimed is:

1. A method of detecting the presence of a conductor near an inductive coupling loop, said method comprising the steps of:

introducing an excitation signal to the coupling loop;

measuring an amount of signal distortion induced by the excitation signal;

monitoring the signal distortion for a change in harmonic content;

notifying a control circuit when changes in harmonic content are detected; and using the monitored changes in harmonic content to control power supplied to a heating element.

2. A method according to claim 1 wherein the signal distortion measured is the third harmonic of the excitation signal.

3. A method according to claim 2 wherein change in third harmonic content is monitored with a gated comparator circuit.

4. A method of detecting the presence of a conductor near an inductive coupling loop, said method comprising the steps of:

introducing an excitation signal to the coupling loop;

measuring an amount of signal distortion induced by the excitation signal;

monitoring the signal distortion for a change in harmonic content; and determining a temperature when changes in harmonic content are detected.

5. A system for detecting the presence of a conductor near an coupling loop comprising:

a coupling loop;

an excitation circuit configured to introduce an excitation signal to the coupling loop;

monitoring circuit configured to measure signal distortion at the coupling loop, to monitor signal distortion for a change in harmonic content, and to use detected changes in harmonic content to control power supplied to a heating element.

6. A system according to claim 5 wherein said monitoring circuit is further configured to monitor the third harmonic of the excitation signal.

7. A system according to claim 6 wherein said monitoring circuit further comprises a gated comparator circuit.

8. A system according to claim 5 wherein said coupling loop is located in a cooktop and the conductor detected is a piece of cookware.

9. A system according to claim 8 further configured to determine a size of the cookware.

10. A system according to claim 8 further configured to determine a temperature within the cookware.

11. A system according to claim 5 further comprising a plurality of said coupling loops, one for each of a plurality of heating elements.

12. A system according to claim 11 wherein said excitation circuit is further configured to excite a plurality of said coupling loops.

13. A system according to claim 12 wherein said monitoring circuit is further configured to monitor a plurality of said coupling loops.

14. A cooking appliance configured to detect the presence of cookware, said cooking appliance comprising:

a cooking surface;

at least one heating element located under said cooking surface; and a cookware presence detection circuit configured to detect the presence of a piece of cookware on said cooking surface, said circuit comprising at least one coupling loop located under said cooking surface and further located near said at least one heating element, an excitation circuit configured to introduce an excitation signal to the coupling loop; and a monitoring circuit configured to measure signal distortion at the coupling loop and to use detected changes in harmonic content to control power supplied to a heating element.

15. A cooking appliance according to claim 14, wherein said cookware presence detection circuit is further configured to detect the size of a piece of cookware located on said cooking surface.

16. A cooking appliance configured to detect the presence of cookware, said cooking appliance comprising:

a cooking surface;

at least one heating element located under said cooking surface; and a cookware presence detection circuit configured to detect the presence of a piece of cookware on said cooking surface, said circuit comprising at least one coupling loop located under said cooking surface and further located near said at least one heating element, an excitation circuit configured to introduce an excitation signal to the coupling loop; a monitoring circuit configured to measure signal distortion at the coupling loop and to determine a temperature inside a piece of cookware located on said cooking surface utilizing said measured signal distortion.

17. A cooking appliance in accordance with claim 16 wherein said monitoring circuit is configured to detect boiling.

18. A cooking appliance in accordance with claim 17 wherein said monitoring circuit is further configured to control power supplied to a heating element to control boiling.

* * * * *